US011363399B2

(12) United States Patent
MacKinnon

(10) Patent No.: US 11,363,399 B2
(45) Date of Patent: Jun. 14, 2022

(54) SYSTEM AND METHOD FOR COMPLEMENTARY AUDIO OUTPUT

(71) Applicant: Genelec Oy, Iisalmi (FI)

(72) Inventor: Giles MacKinnon, Iisalmi (FI)

(73) Assignee: Genelec Oy, Iisalmi (FI)

( * ) Notice: Subject to any disclaimer, the term of this patent is extended or adjusted under 35 U.S.C. 154(b) by 0 days.

(21) Appl. No.: 17/002,849

(22) Filed: Aug. 26, 2020

(65) Prior Publication Data

US 2021/0067893 A1 Mar. 4, 2021

(30) Foreign Application Priority Data

Sep. 2, 2019 (FI) ..... 20195726

(51) Int. Cl.
*H04S 7/00* (2006.01)

(52) U.S. Cl.
CPC ..... *H04S 7/302* (2013.01)

(58) Field of Classification Search
CPC ... G10L 19/008; G10L 19/0204; G10L 19/26; H04S 2400/11; H04S 2420/03; H04S 7/301; H04S 7/302; H04S 2420/07
USPC ..... 381/303, 17, 300, 22, 307
See application file for complete search history.

(56) References Cited

U.S. PATENT DOCUMENTS 4,239,939 A 12/1980 Griffis
9,794,710 B1 * 10/2017 Sheen ..... G06F 3/162
9,860,670 B1 * 1/2018 Sheen ..... H04R 27/00
2004/0033056 A1 * 2/2004 Montag ..... H03G 5/005 381/113
2010/0290643 A1 11/2010 Mihelich
2013/0243227 A1 * 9/2013 Kinsbergen ..... H04M 1/72478 381/314
2014/0177846 A1 * 6/2014 Strub ..... G06F 3/0334 381/17

(Continued)

FOREIGN PATENT DOCUMENTS

AU 7140591 A 7/1991
CN 101053152 A 10/2007

(Continued)

OTHER PUBLICATIONS

GENELEC Operating Manual, Mar. 2016.

(Continued)

*Primary Examiner* — Alexander Krzystan
(74) *Attorney, Agent, or Firm* — Laine IP Oy

(57) ABSTRACT

According to an example aspect of the present invention, there is provided a sound system, the sound system comprising: a first loudspeaker, comprising at least one first speaker element, a second loudspeaker, comprising at least one second speaker element, wherein the first and second loudspeaker have at least partially overlapping frequency ranges, and the first speaker is configured to produce a response within at least one first operating band defined within the frequency range of the first speaker, and the second speaker is configured to produce a response within at least one second operating band defined within the frequency range of the second speaker, and the first and second operating bands do not overlap, and wherein the overall response of the sound system at a first location is comprised of the response within the first operating band and the response within the second operating band.

19 Claims, 10 Drawing Sheets

(56) References Cited

U.S. PATENT DOCUMENTS

2017/0257722 A1* 9/2017 Kerdranvat ..... H04S 7/301

FOREIGN PATENT DOCUMENTS

| | | | |
|---|---|---|---|
| CN | 101361405 | A | 2/2009 |
| CN | 102696244 | A | 9/2012 |
| CN | 103621110 | A | 3/2014 |
| JP | S5510274 | A | 1/1980 |
| JP | H09289697 | A | 11/1997 |
| JP | 2016502375 | A | 1/2016 |
| JP | 2016539539 | A | 12/2016 |
| WO | WO0189083 | A1 | 11/2001 |
| WO | WO2007016527 | A1 | 2/2007 |
| WO | WO2011114252 | A1 | 9/2011 |
| WO | WO2017059934 | A1 | 4/2017 |

OTHER PUBLICATIONS

Hofmann et al: Generalized Wave-Domain Transforms for Listening Room Equalization With Azimuthally Irregularly Spaced Loudspeaker Arrays. IEEE Int Conference on Acoustics, Speech and Signal Processing (ICASSP), Mar. 2016.

Wagner et al: Automatic Calibration and Equalization of a Line Array System. Proc. of the 18th Int Conference on Digital Audio Effects (DAFx-15), Dec. 3, 2015.

* cited by examiner

SYSTEM AND METHOD FOR COMPLEMENTARY AUDIO OUTPUT

FIELD

This disclosure provides a system and method for improving the response of sound systems using complementary audio output, in particular in the field of sound and audio applications.

More specifically, the present disclosure provides a sound system, the sound system comprising: a first loudspeaker, comprising at least one first speaker element, a second loudspeaker, comprising at least one second speaker element, wherein the first and second loudspeaker have at least partially overlapping frequency ranges, and the first speaker is configured to produce a response within at least one first operating band defined within the frequency range of the first speaker, and the second speaker is configured to produce a response within at least one second operating band defined within the frequency range of the second speaker, and the first and second operating bands do not overlap, and wherein the overall response of the sound system at a first location is comprised of the response within the first operating band and the response within the second operating band.

BACKGROUND

A listening room or listening space has a significant effect on an audio system's sound output at the listener position or a listening position or location. The interaction between the acoustics of a space and loudspeaker radiation is complex. Each space changes somewhat the monitor's response in a unique way, e.g. reflective vs. damped rooms, or placement against a wall vs. on a stand away from the walls. The effect of the listening space may be termed the "room response". The effect of the listening space may therefore cause disadvantageous effects on the sound quality of the sound system, speaker system, individual loudspeaker or individual speaker element. When the effect of the listening space is minimized by calibration, this results in a system having a more consistent sound character with a flat frequency response at the listening position. In this way, the different acoustic spaces (rooms) begin to sound more systematically similar than without calibration. This results in a neutral sound character, meaning sound that doesn't decrease or increase on certain frequencies but contains an equal amount of all audible frequencies i.e. a flat frequency response.

SUMMARY OF THE INVENTION

The invention is defined by the features of the independent claims. Some specific embodiments are defined in the dependent claims.

According to a first aspect of the present invention, there is provided a sound system, the sound system comprising: a first loudspeaker, comprising at least one first speaker element, a second loudspeaker, comprising at least one second speaker element, wherein the first and second loudspeaker have at least partially overlapping frequency ranges, and the first speaker is configured to produce a response within at least one first operating band defined within the frequency range of the first speaker, and the second speaker is configured to produce a response within at least one second operating band defined within the frequency range of the second speaker, and the first and second operating bands do not overlap, and wherein the overall response of the sound system at a first location is comprised of the response within the first operating band and the response within the second operating band.

According to a second aspect of the present invention, there is provided a method of improving the quality of the response of a sound system, the method comprising: measuring at a first location the room response of a first speaker to obtain a first response, measuring at the first location the room response of a second speaker to obtain a second response, analyzing the first and second responses, based at least partly on the analysis, dividing the frequency range of the first and second response into operating bands, based at least partly on the analysis, assigning the first or the second speaker to each operating band, based at least partly on the assigning, generating a first set of filters for the first speaker and a second set of filters for the second speaker, and providing the first set of filters to the first speaker and the second set of filters to the second speaker in order to implement an overall sound system response.

Various embodiments of the first or second aspect may comprise at least one feature from the following bulleted list:

- wherein the operating bands have been selected in such a manner that the overall response of the sound system is flatter in comparison to the response without the operating bands,
- wherein the first operating band and second operating band are defined based at least partly on a first measurement and a first determination,
- wherein the sound system further comprises a third speaker with a third room response at the first location, wherein the third speaker is configured to produce sound within at least one operating band within the frequency range of the third speaker, and wherein the first, second and third operating bands do not overlap,
- wherein the loudspeakers are active loudspeakers,
- wherein the first, second and third speaker are located within a single enclosure,
- wherein at least some of the speakers are comprised of multiple speaker elements,
- wherein at least some of the speakers are comprised of a combination of woofers, subwoofers and tweeters,
- wherein at least one speaker is used for at least two operating bands to form the overall response of the system,
- wherein equalisation is used to fit the response of the individual speakers to a magnitude target of the overall system response,
- wherein all-pass equaliser parameters and group delay are optimised between the individual speakers.
- wherein the division of the operating bands is performed based at least in part on the measured response, wherein at least one speaker is used for at least two operating bands to form the overall response of the system.

In at least some of the embodiments of the disclosure, a non-transitory computer readable medium is provided having stored thereon a set of computer readable instructions that, when executed by at least one processor, cause an apparatus to perform at least some of the above-mentioned aspects of the invention, optionally including the features presented in the bulleted list above.

EMBODIMENTS

Figure 1A:
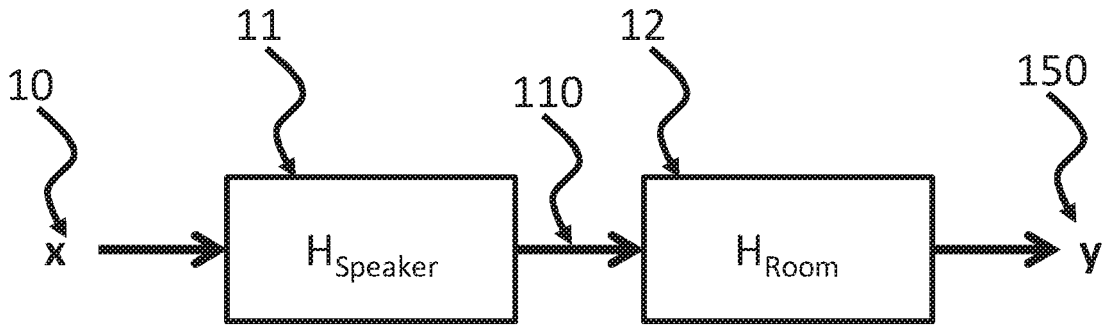
FIGS. 1A and 1B illustrate a schematic view and a plot of an exemplary loudspeaker response in accordance with at least some embodiments of the present invention.

The present disclosure provides a system and a method comprising measurement, analysis and equalization of speaker elements in order to reduce the effect of the room at the listener position. More specifically, the overall response of the sound system is measured and divided into operating bands, wherein selected responses are then assigned to each operating band in order to achieve an optimal response.

The resulting response at the listening position for a specific space is tied to both the location of the speaker and the listening position. Changing the position of the speaker with respect to a listening position, changing the listening position with respect to the speaker or changing both positions within a given room will result in a change in the resulting response at the listener location.

Within the present disclosure this effect is beneficially utilized to produce an overall flat frequency response in a given room by selectively using frequency ranges from selected loudspeakers which are less affected by the effect of the listening space in the selected frequency ranges.

The measuring process comprises determining the operating frequency range of the individual units by the analysis of individual in-room responses of individual reproduction elements at the at least one microphone locations, by assessing a number of metrics as disclosed elsewhere in this disclosure. The frequency range, also termed the operating frequency range, begins at the minimum frequency and continues to the maximum frequency emitted by the speaker element or loudspeaker or sound system. In other words, the frequency range is the range that the device is capable of expressing sound within.

Filters are designed to fit the individual unit response to the magnitude target, and all-pass filter optimisation used to match the individual unit response at the listener position. By reducing the dips in the response, the effect of the room is reduced at the listener position. Filters in accordance with the present disclosure may comprise at least one of the following: all-pass filters, roll-off filters, shelving filters, band-stop filter, band-pass filters, parametric filters, in particular a parametric shelving filter which has one or more sections which each implements a second-order filter function involving at least three arguments: the center frequency, the Q, and the gain which determines how much those frequencies are boosted or cut relative to frequencies significantly above or below the center frequency selected. It is understood that in the context of the present disclosure responses which are not being used within a specific operating band may be muted, i.e. the entirety of the response is filtered within the specific operating band. Optimisation of the all-pass equaliser parameters and group delay may be performed via any suitable methods including calculation methods disclosed herein.

Loudspeakers are used within the context of the present disclosure to produce sound, i.e. to produce an individual response, the response having a magnitude over a frequency range. Loudspeakers typically comprise a cabinet and speaker elements. Loudspeakers within the present disclosure may be active loudspeakers wherein at least one amplifier is within the loudspeaker cabinet. Benefits of an active loudspeaker are that the amplifier will match the speaker element requirements and that the digital sound processing components, DSP, can be included within the cabinet. However, so-called passive loudspeakers are also usable with the methods and devices presented herein.

A loudspeaker in accordance with the present disclosure may comprise a so-called M-way speaker, which is speaker with M individual sections. For example, a speaker may be a 2-way loudspeaker comprised of a woofer element and a tweeter element, or a speaker may be a 3-way loudspeaker comprised of a woofer element, a midrange element and a tweeter element. A loudspeaker may also be comprised of a subwoofer element, which is a speaker element. Loudspeakers may be active speakers or passive speakers. The speaker elements may be dynamic speaker elements or other types of elements usable to convert electrical signals into audio.

A sound system comprising at least one loudspeaker is used within the present disclosure to produce the total system response. For example, a sound system comprising two speaker elements X and Y, wherein first speaker element X produces response x1 and second speaker element Y produces response y1, will have a total system response of x1y1. The total system response is linked to the listener position, which is a stationary position within a space such as a room. The listener position may be determined by the features of the room, via analysis or via calibration. The sound system may also comprise a microphone, a microphone amplifier, a sound source and/or a network interface. Benefits of including a microphone are that the system will have the possibility for closed-loop control.

A loudspeaker has an anechoic response, which is the response the loudspeaker produces in the absence of any other responses, i.e. when the room response is zero. A loudspeaker is comprised of a cabinet, which may also be called an enclosure, at least one speaker element. An active loudspeaker is further comprised of an amplifier and optionally a digital sound processor, DSP. A cabinet defines the physical volume of the loudspeaker and has a major effect on the acoustic properties of the speaker. Cabinets which are at least partially comprised of aluminium are beneficial for the rigidity of construction of the cabinet, coupled with the lightness of the cabinet.

In accordance with the present disclosure, magnitude targets for responses may be set and utilized as part of at least some of the determinations used within the embodiments of the disclosure. A magnitude target may be expressed relative to another speaker or response thereof, or as an absolute dB, decibel, value. A magnitude target for a given local response, global response and/or overall response may be expressed in decibels, such as 80 dB to 100 dB, in particular 85 dB. A relative target may be 0 dB relative to response of at least one other speaker. The effect of achieving a response meeting the magnitude target is that the system then has sufficient or even ideal performance at the given frequency or for the overall response.

FIG. 1A illustrates an exemplary response of a sound system in accordance with at least some embodiments of the present invention. In the embodiment presented in FIG. 1A, a loudspeaker is used to produce resulting sound y 150 from input signal x 10. The resulting response is a combination of the loudspeaker (anechoic) characteristics 11 and the room transfer function 12. The room transfer function is determined by the location of the speaker and listener (or microphone) in the space. The speaker anechoic response 110 is therefore the speaker response without the effect of the room transfer function.

Figure 1B:
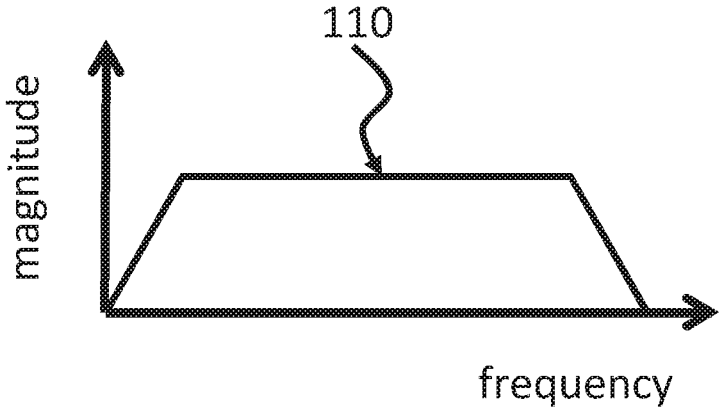

FIG. 1B illustrates the exemplary speaker anechoic response 110 as a frequency and magnitude plot, wherein magnitude is the y axis and frequency is the x axis.

Figure 2:
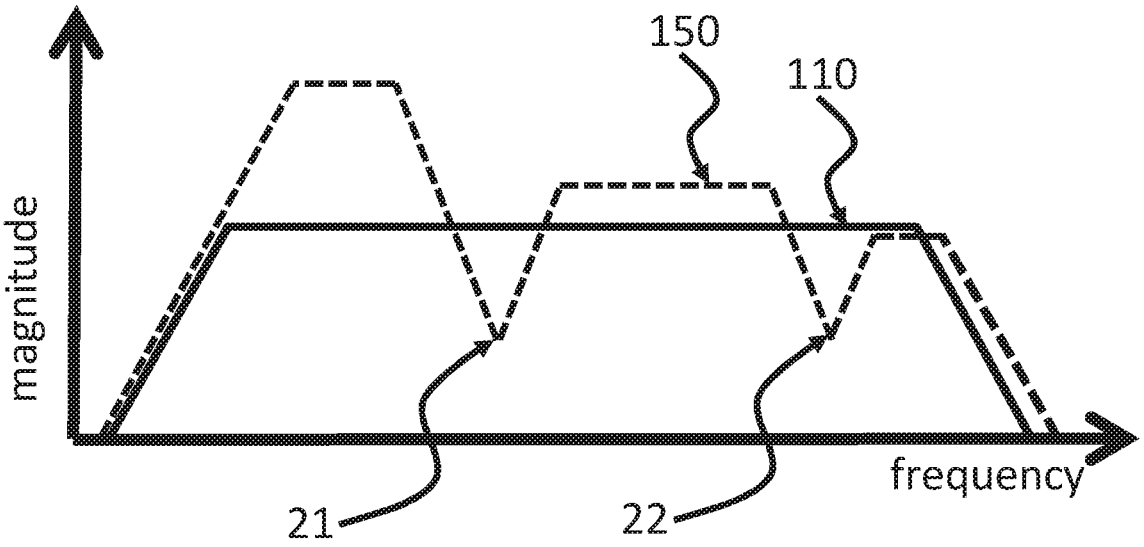
FIG. 2 illustrates a schematic plot of an exemplary loudspeaker response in accordance with at least some embodiments of the present invention.

FIG. 2 illustrates the resulting response 150 at the listening position, e.g. a location within a room, as a frequency and magnitude plot. The room reflections and other acoustic issues cause heavy notches 21 and 22 at the listening position in comparison to the loudspeaker anechoic response 110.

Figure 3A:
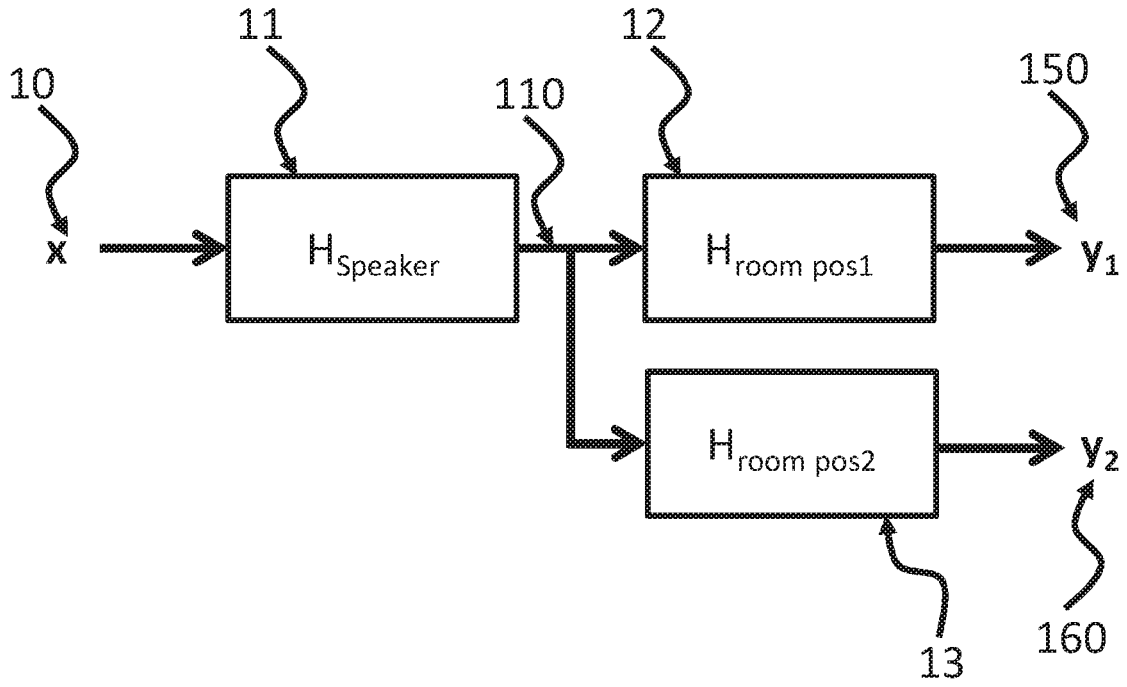
FIGS. 3A and 3B illustrate a schematic view and a plot of an exemplary loudspeaker response in accordance with at least some embodiments of the present invention.

FIG. 3A illustrates the effect of the loudspeaker location. Moving the speaker (or microphone) to a different location within the room adjusts the intensity and arrival time (and therefore phase relationship) of these individual reflections—resulting in a (potential) shift in the location (frequency) and magnitude of the notches. In FIG. 3, the sound x 10 is radiated by loudspeaker 11. In a first position $pos_1$ 12, the resulting sound is $y_1$ 150. However, as shown in the figure, in a second position $pos_2$ 13, which is different from the first position, the resulting sound is $y_2$ 160.

Figure 3B:
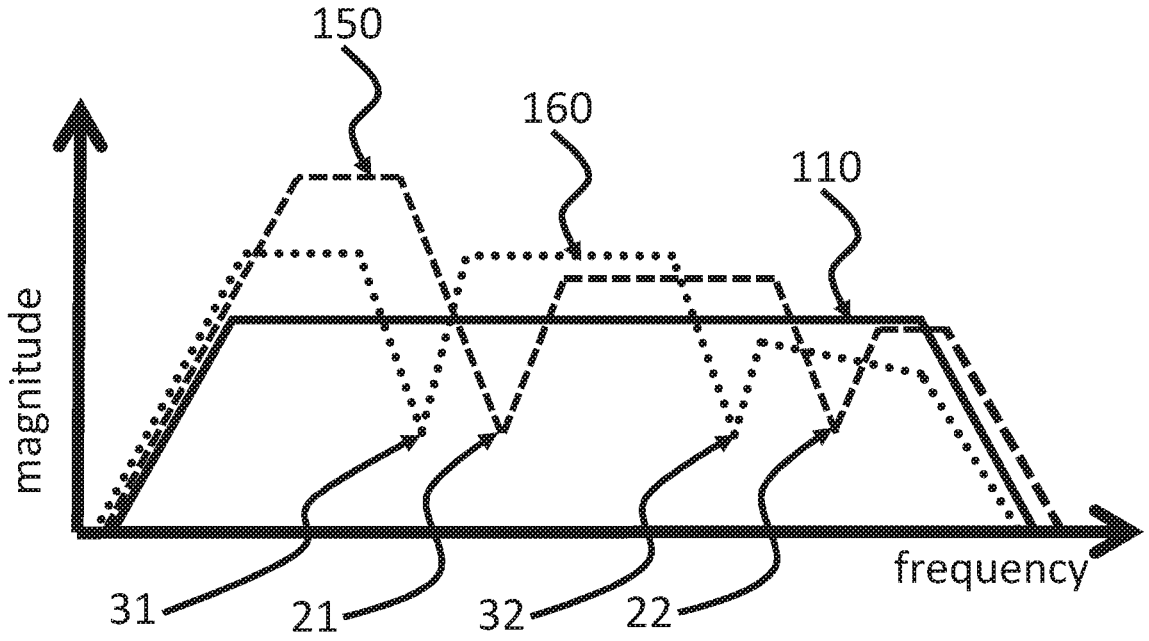

FIG. 3B illustrates the effect of the loudspeaker location on the response, shown in the magnitude and frequency graph. The resulting sound 150 from loudspeaker position $pos_1$ has notches 21 and 22, whereas the sound 160, resulting from loudspeaker position $pos_2$, has notches 31 and 32. Notches 21 and 22 are located at different frequencies from notches 31 and 32. The resulting sounds 150 and 160 are shown in comparison to the loudspeaker anechoic response 110.

Figure 4A:
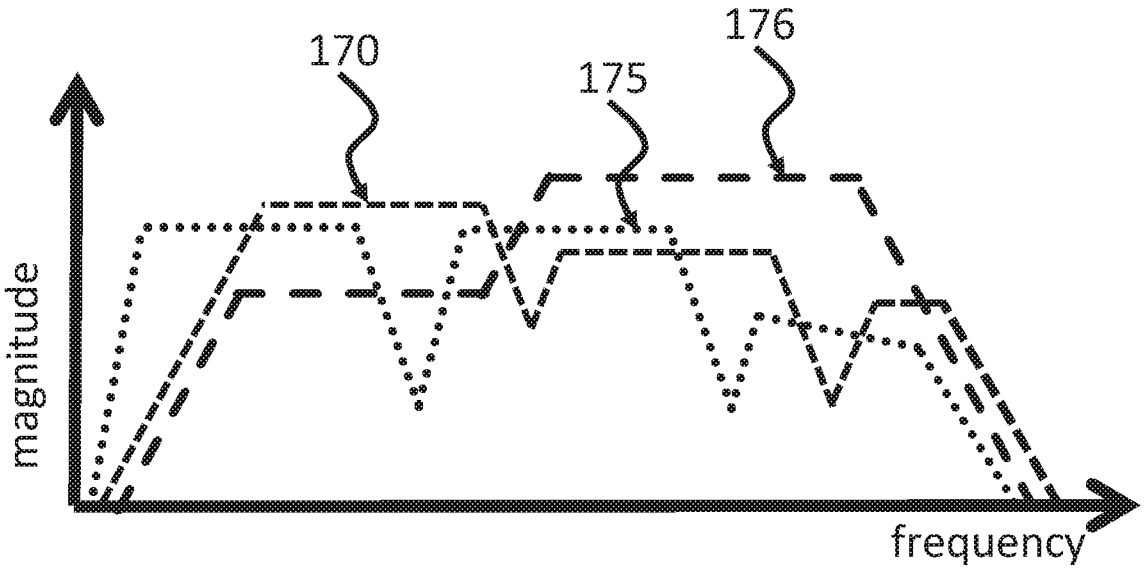
FIGS. 4A, 4B, 4C and 4D illustrate exemplary plots of an exemplary sound system response in accordance with at least some embodiments of the present invention.

FIG. 4A illustrates an exemplary embodiment wherein a first, second and third speaker are positioned at different locations within the room, produce responses 170, 175 and 176 respectively. Said responses shown on a magnitude and frequency graph. It can be seen that the responses vary and have different characteristics such as notches at different frequencies. Said speakers may be speaker elements or alternatively loudspeakers.

Figure 4B:
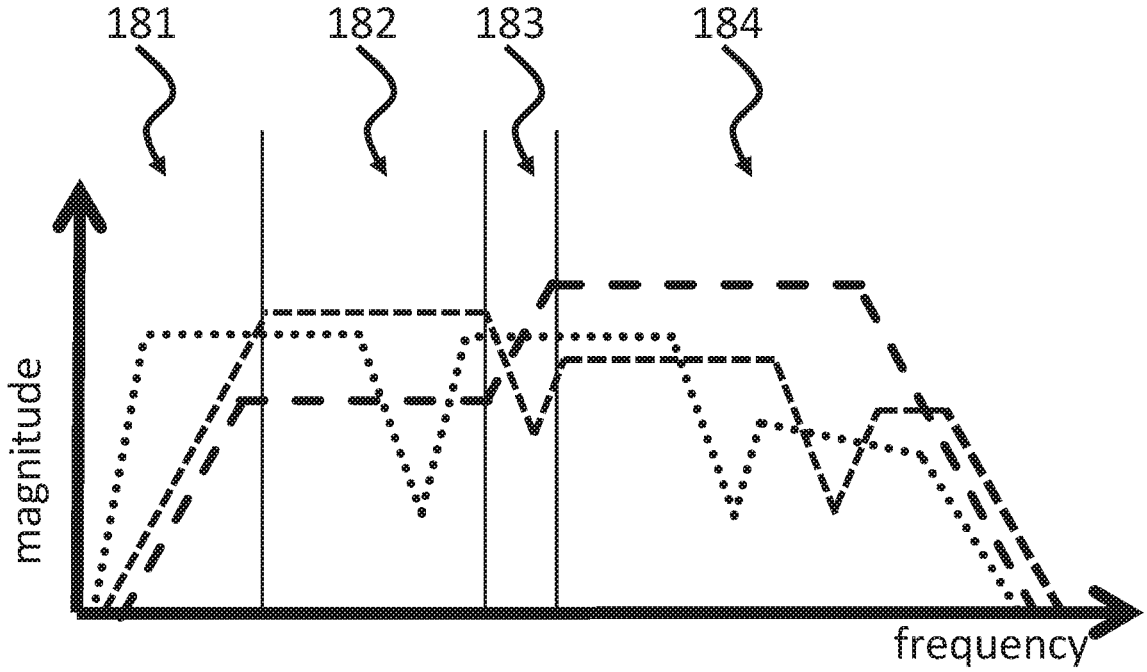

FIG. 4B illustrates the exemplary embodiment from FIG. 4A, wherein operating bands for each individual speaker are selected in order to optimize the combined system response. The total frequency range has been divided into operating bands 181, 182, 183 and 184 represented by the vertical lines. As can be seen from FIGS. 4A and 4B, in the operating band 181 the response 175 has the flattest response and highest output and therefore it is beneficial for the system to use the second speaker for the total system response in the band 181. Turning then to the band 182, in this band the flattest response is that of the first speaker, i.e. response 170 and that response is used for the total system response. In band 183, the flattest response is again the response 175 and that is used for the total system response. Finally, in band 184 the flattest response is that of response 176 and that response is used for the total system response. The total system response therefore is comprised of the response 175 in band 181, the response 170 in band 182, the response 175 in band 183 and the response 176 in band 184. In order to obtain an even flatter response, selected bands and/or responses may be subjected to equalization procedures such as amplification in this and other embodiments of the disclosure. In addition, in the context of the disclosure the frequency range may be divided into any number of bands, preferably between 1 and 1000 bands, in particular between 2 and 20 bands.

In a further exemplary embodiment in accordance with the present disclosure, the frequency range presented on the x-axis of FIGS. 4A and 4B may be from 10 Hz to 21 kHz, with the band 181 being from 10 Hz to 50 Hz, the band 182 being from 50 Hz to 100 Hz, the band 183 being from 100 Hz to 300 Hz and the band 184 being from 300 hZ to 21 khz. Division of the total frequency range into bands may be done based on preset values or the division may take into account the measured responses. For example, it is beneficial to locate the demarcation of the operating bands between two notches, thereby allocating the notches to different operating bands and therefore allowing for the elimination of the notches singly rather than jointly. After the division has been performed, the responses within each operating band are evaluated and selected responses from the speakers are assigned to each operating band. One or more responses may comprise the response within the operating band. Evaluation of the responses within the bands and allocation of responses to bands is done in accordance with methods disclosed elsewhere in this disclosure.

Figure 4C:
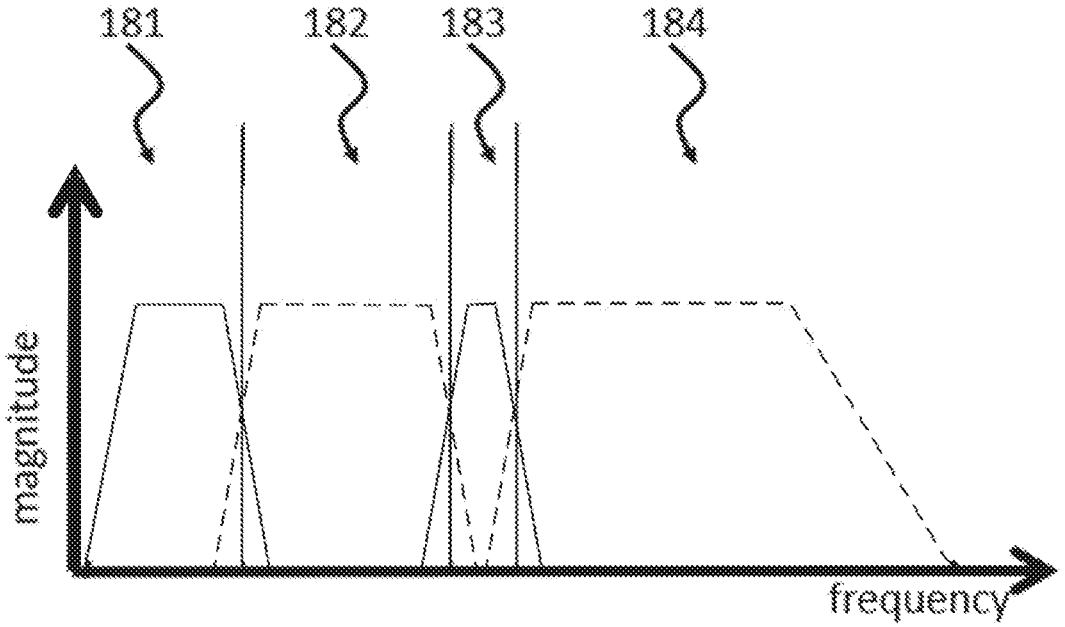
Figure 4D:
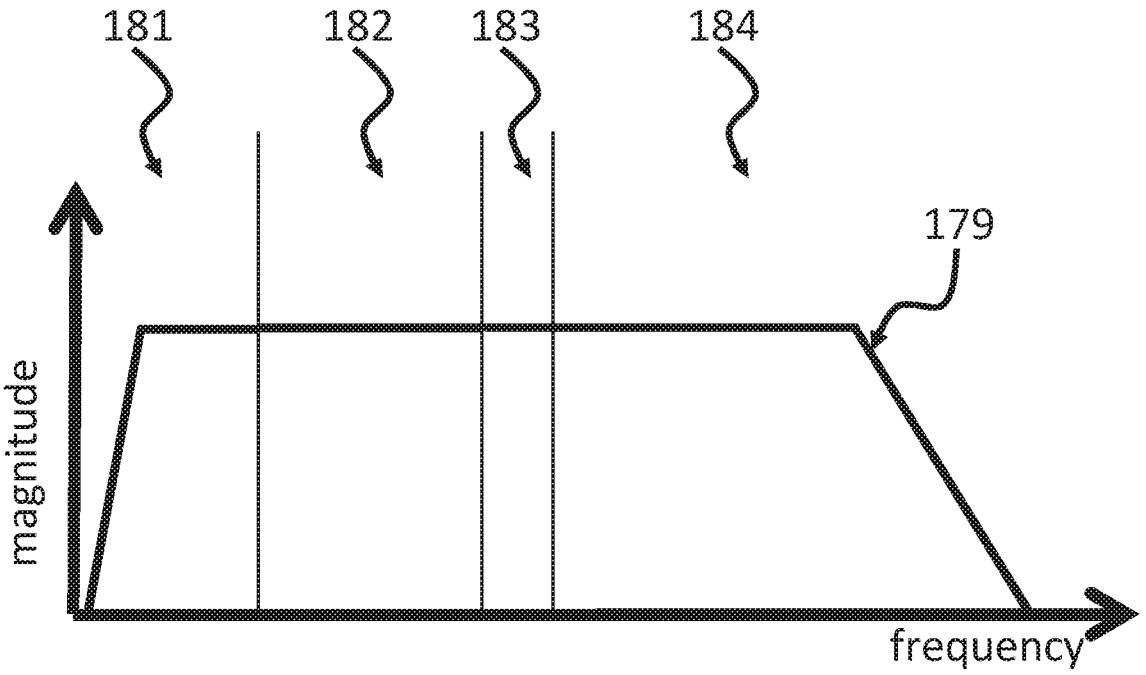

FIG. 4C shows the resulting responses of selected individual speakers within the individual bands 181, 182, 183 and 184. It can be seen in said Figure that in at least some embodiments in accordance with the present disclosure the responses are not merely flat lines but also incorporate rising slopes and falling slopes as required. An overlap of 1 to 30 percent between bands may be beneficially present in the frequency range, more specifically 10%. This allows the filter limiting the response to the operating band to have a less abrupt beginning and end. FIG. 4D displays the resulting total system response after equalization procedures have been completed. It can be seen in FIG. 4D that the total system response 179 is essentially flat in comparison to the individual responses of FIG. 4A.

Figure 5:
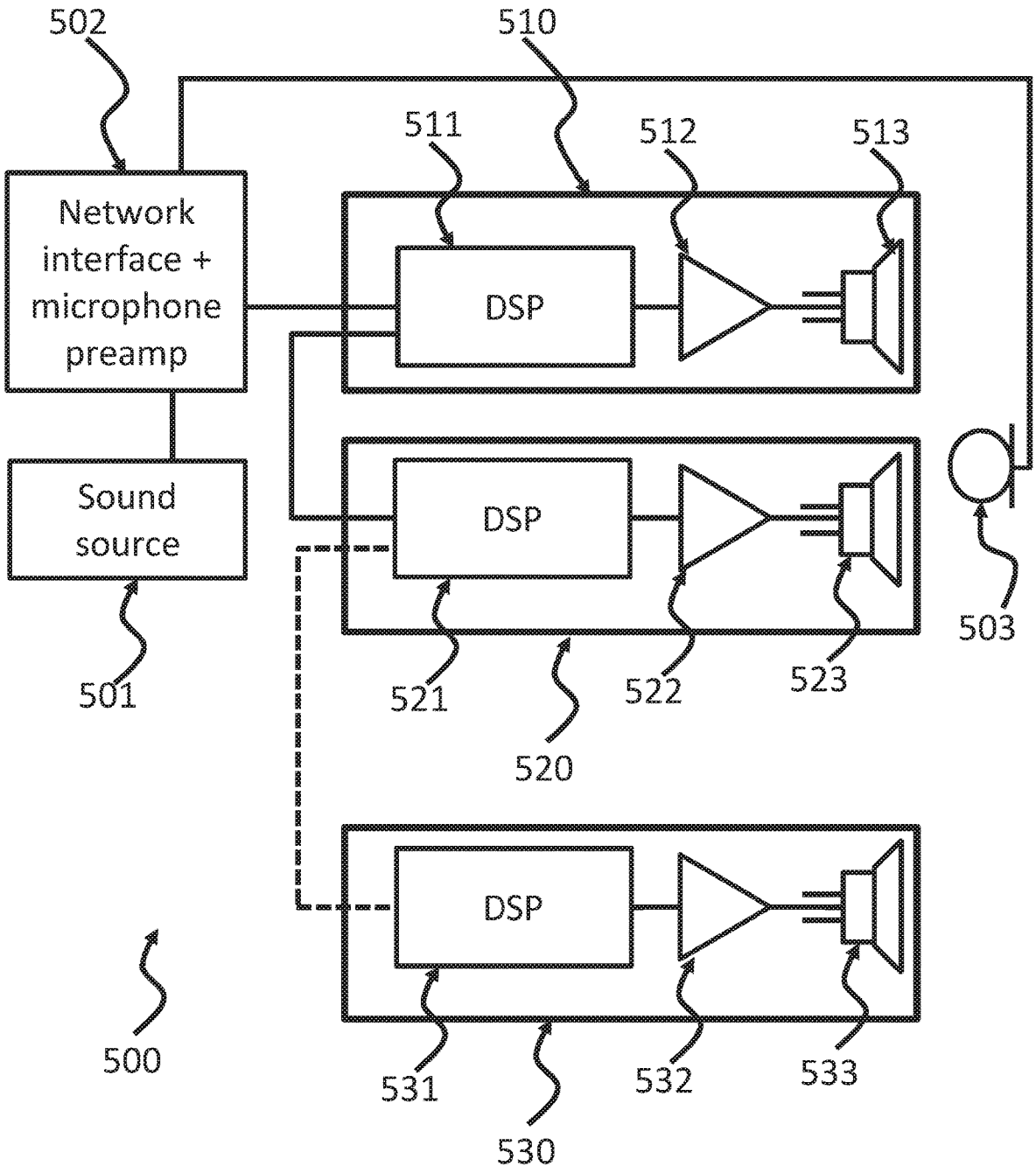
FIG. 5 illustrate a schematic view of an exemplary sound system capable of supporting at least some embodiments of the present invention.

FIG. 5 shows an exemplary embodiment which allows use of the methods presented within the present disclosure. Audio system 500 is comprised of sound source 501, network interface and microphone preamplifier 502, microphone 503 and at least one speaker 510. Audio system 500 may be referred to as a sound system as well. Elements 501, 502 and 503 may be combined into a single unit in further exemplary embodiments, or, in other further exemplary embodiments, one or more of said elements may be omitted from the system. Speaker 510 may comprise digital sound processor 511, amplifier 512 and at least one speaker element 513. The elements of speaker 510 are typically located within a single housing. In the embodiment shown in FIG. 5, a second speaker 520 and an optional third speaker 530 are also present. In other words, in at least some embodiments are comprised of two speaker units and at least some other embodiments are comprised of three speaker units. Further, the number of speaker units usable in accordance with the methods of the present disclosure may be represented as the variable n, wherein n is a positive integer, preferably between 1 and 10,000, in particular between 2 and 20.

The second speaker 520 and the third speaker 530 may be identical to the first speaker 510 or they may differ in characteristics such as components used, frequency range, type of digital sound processing, et cetera. The speakers may have different locations with respect to the listening position.

In an exemplary method usable with the embodiment illustrated in FIG. 5, the sound signal is reproduced via speakers 510, 520 and optionally 530. The sound signal may be different for each speaker. The sound signal may be reproduced by the speakers sequentially, that is to say one speaker at a time, or, in an alternative embodiment, the speakers may reproduce different sounds simultaneously. The sound signal may be a test signal, for example a sweep of frequencies starting at 10 Hz and continuing to 21 kHz. Said sound signal is then measured by the microphone 503 at the listening position and the measurements are stored on the network device 502 for analysis. Alternatively, the analysis may be conducted on a remote server.

The individual responses for each of the individual elements at the microphone locations are analysed and evaluated using a number of metrics comprising at least one of the following local and global values or calculations: flatness of response, magnitude of the response, slope of the response, average magnitude of the response, weighted average of the response, notch characteristics including position and slope degree of the notch. Fourier analysis and/or Fourier methods may be used at least in part to evaluate the responses. The result of the analysis and evaluation is that individual operating bands for each unit are determined. Filters are then designed for each of the individual sections to match the response to the individual band target response, i.e. filters for each speaker are designed to achieve the required response in each band. Such filters may comprise any of the filters disclosed within this document. All-pass equalisation and group delay is optimised for the individual units to ensure maximum summing of the complex responses.

To elaborate, frequency response graphs of the output of the speakers are generated by the network device 502. After the responses have been generated, analysis of the responses performed based on the metrics to obtain an indication of flat portions, peaks and notches in the response. Obtaining the indication may also be termed a first determination and may utilize the metrics and calculation methods disclosed within this disclosure. The indication from an individual speaker is then evaluated with respect to the same indication from the other speakers. The optimal solution is then solved via calculation methods done on the measured response and/or a simulated response comprising at least the following: least squares method, linear least squares method, non-linear least squares method, ordinary least squares method, weighted least squares method, generalized least squares method, partial least squares method, total least squares method, non-negative least squares method, ridge regression method, regularized least squares method, least absolute deviations method, iteratively reweighted least squares method, bayesian linear regression, bayesian multivariate linear regression, linear regression, polynomial regression, binomial regression. Values involved in the calculations are at least one of the following variables of the measured or simulated response: flatness, magnitude, slope, average magnitude, weighted average, notch characteristics including position and slope degree of the notch. Fourier analysis and/or Fourier methods may be used at least in part in said calculations.

Based on the calculations, a total system response is generated wherein selected frequency bands are assigned to specific loudspeakers in order to achieve said generated total system response. The calculations may optionally comprise at least one of the following: magnitude optimization of the individual bands, phase optimization.

Implementation of the total system response is achieved by creating filters for the individual speakers and transmitting said filters to the speakers. The filters may be implemented by the digital signal processor, DSP, of the speaker. The speakers may store the filters within the enclosure. Said filters may be also stored on a remote server, for example to prevent data loss. Filters may be stored as a set for at least the following: for the entire system, for each band, for each speaker, for each loudspeaker element. Storing filters and filter sets as digital files allows for the possibility of backup and export of the filters, for example in cases wherein multiple rooms have identical acoustic properties and identical sound systems are installed in each room. The implementation may optionally be verified by repeating the measurement and optionally by repeating the analysis, filter generation and filter implementation steps of the method, with a beneficial effect of having increased accuracy. Such repetition may be termed an iterative process.

In a third exemplary embodiment in accordance with the present disclosure, the responses of multiple pairs of speakers are adjusted in accordance with the methods presented herein. More specifically, the response of a pair of speakers is first measured using a microphone at the listening position and then another pair of speakers, having a different room position is measured.

Figure 6:
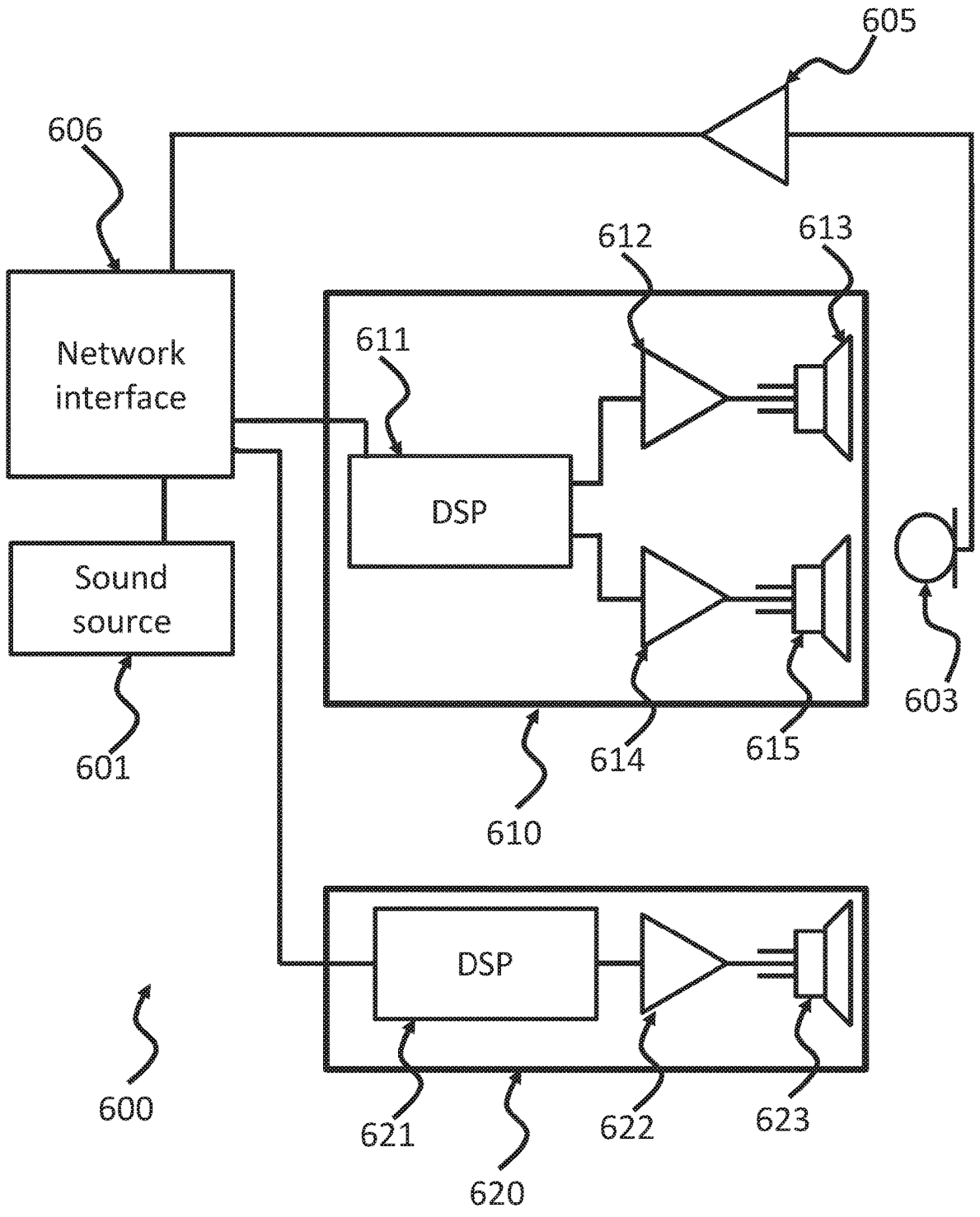
FIG. 6 illustrate a schematic view of an exemplary sound system capable of supporting at least some embodiments of the present invention.

In a fourth exemplary embodiment in accordance with the present disclosure and illustrated in FIG. 6, sound system 600 is comprised of sound source 601, network interface 606, microphone preamplifier 605, microphone 603 and speakers 610 and 620. Speaker 610 is a multi-element speaker comprising DSP 611 and amplifiers 612 and 614 and speaker elements 613 and 615. Speaker 620 is a single-element speaker, but may also be a multi-element speaker such as speaker 610 in a further exemplary embodiment. Speaker 620 is directly connected to the network interface by one of the connection means disclosed later in this document.

The overall response of sound system 600 may be obtained via methods consistent with the methods presented in the disclosure, namely using a measuring microphone and measuring the response based on a test signal from 10 Hz to 21 kHz, or vice versa. At least one of the following will be measured as part of the measurement process: overall response of the sound system, individual responses from the speakers.

Figure 7:
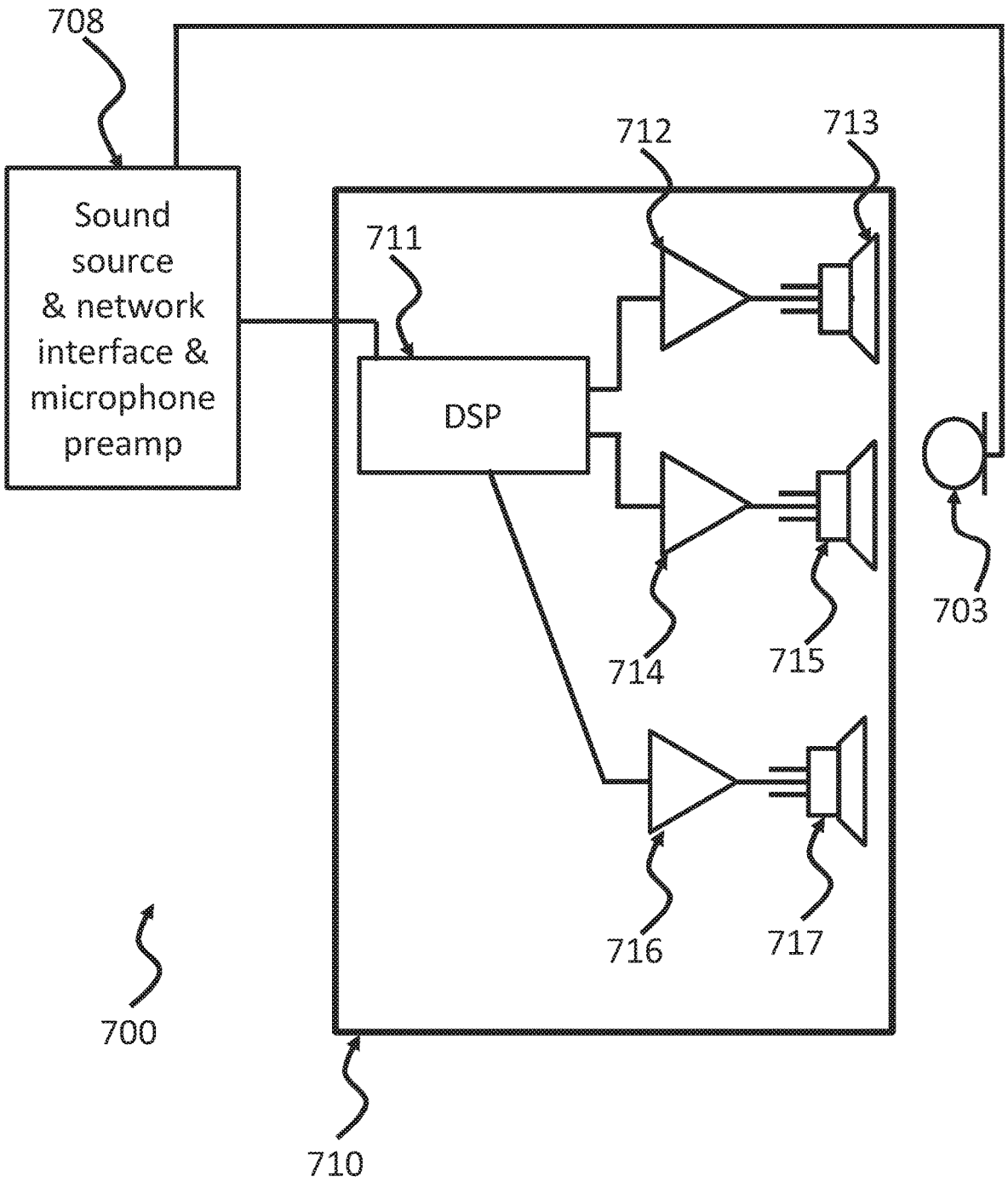
FIG. 7 illustrate a schematic view of an exemplary sound system capable of supporting at least some embodiments of the present invention.

In a fifth exemplary embodiment in accordance with the present disclosure the sound system 700, illustrated in FIG. 7, the sound system is comprised of control unit 708 comprising a sound source, network interface, and microphone preamp; microphone 703 and loudspeaker 710 comprising a DSP 711, three amplifiers 712, 714 and 716 and three speaker elements 713, 715 and 717. In a beneficial embodiment, the elements 713 and 717 have only minimal overlap of operating range frequencies with respect to one another or alternatively zero overlap, with the beneficial effect of having a wide frequency range of the loudspeaker 710. The speaker element 715 may have an overlap with both of the elements 712 and 716 with the beneficial effect that methods in accordance with the present disclosure may be effectively used throughout the frequency range of element 715. The overlap between element 715 and element 717 may be from 1% to 90% of the range of element 717, with the same applying equally for elements 715 and 713. For example, in a further exemplary embodiment element 713 may have a frequency range of 20 Hz to 250 kHz, element 715 may have a frequency range of 50 kHz to 500 kHz, and element 717 may have a frequency range of 300 Hz to 20 kHz. The elements may be of different types; for example element 717 may be a tweeter and element 713 may be a woofer. The elements may be located differently within the enclosure of the loudspeaker, that is to say that a first element may be on the front face of the loudspeaker and a second element may be located on the back face. This has the beneficial effect of providing differing room responses for each speaker element, which when subjected to the methods disclosed herein may lead to a flat frequency response.

In a beneficial exemplary embodiment of the invention the speaker elements are identical, meaning that they have 100% overlap of frequency range. It is also possible that a subset of the total number of speaker elements are identical, for example a three-element speaker may have two identical elements and one non-identical element. Multiple such speakers, e.g. a pair of three-way speakers is also a very suitable sound system for use in accordance with the disclosure presented herein. Overlap between the speaker elements provides flexibility in the total response when speaker elements are situated in different locations on the enclosure. Use of different types of speaker elements provide increased frequency range, especially at very high frequencies and/or very low frequencies.

Figure 8:
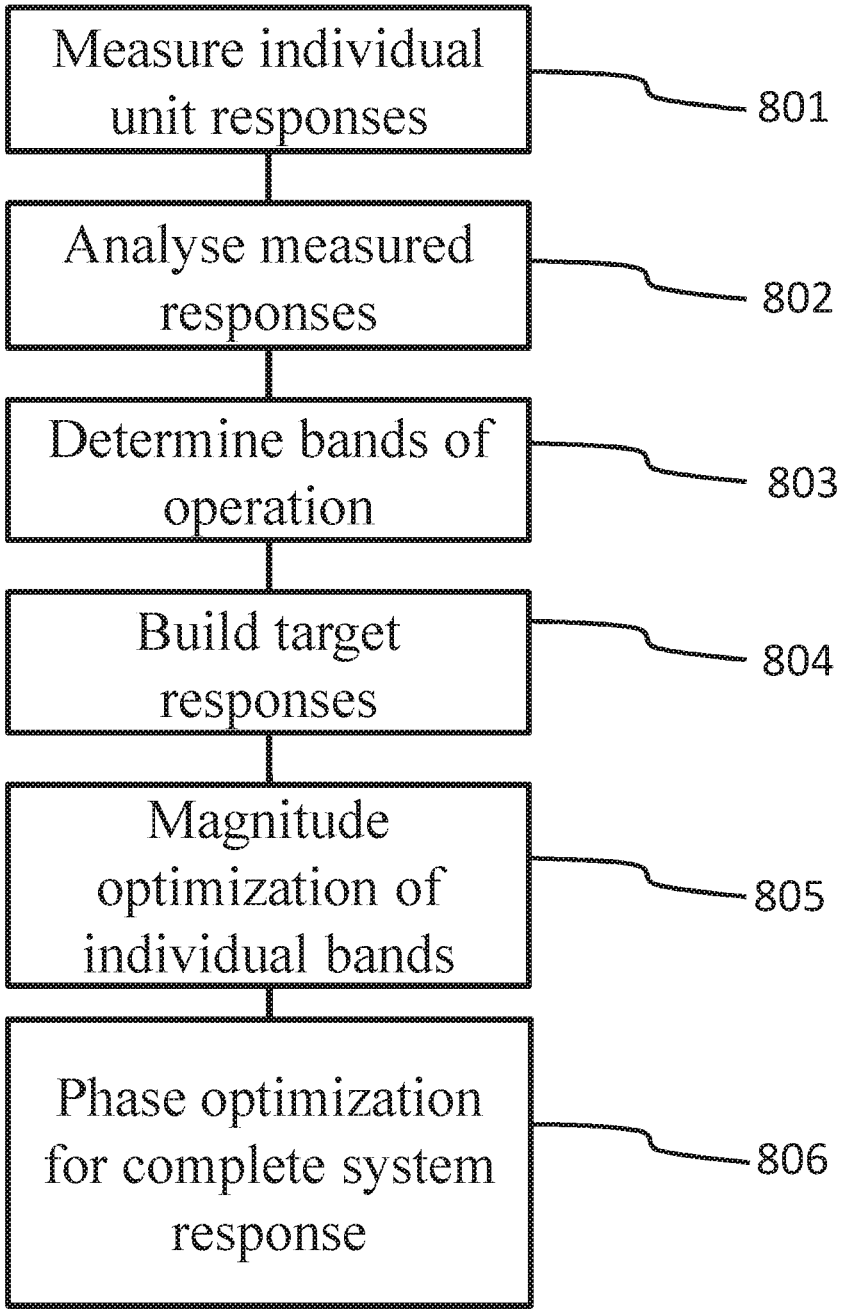
FIG. 8 is a flow graph illustrating an exemplary method in accordance with at least some of the embodiments of the present invention.

An exemplary method in accordance with the present disclosure is presented in FIG. 8. The method begins with step 801 wherein the individual unit responses are measured. The measurement can utilize the microphone means in accordance with any suitable techniques, including those discussed with respect to the embodiments presented herein. The measurement can be done several times, as may the method itself. In a further exemplary method, the measurement is done by measuring the individual response of each speaker in turn. In an alternative exemplary method, the responses may be measured simultaneously.

In step 802, the measured responses are analysed. The measured responses are stored and analysis is conducted based on a number of metrics as discussed within this disclosure to determine the frequency and magnitude plot of each speaker. The analysis may be done by network interface 502, singly or jointly by any of the DSP's in the sound system such as 611 or 612, or in an alternative exemplary method, by uploading the files to a remotely located server which performs the analysis.

In step 803, the bands of operation are determined as disclosed elsewhere in this disclosure. This step may be done in conjunction with step 802 either by network interface 502 or by a remote server. In step 804, the target responses are determined via modelling of the expected target response. Step 804 may be performed individually for each speaker element or for the system as a whole, either globally or one operating band at a time. In step 805, magnitude optimization of the determined individual bands is conducted. Finally, in step 806, phase optimization is conducted for the final system response. Subsequently, the filters for the speakers are generated and transmitted to the speakers, as disclosed elsewhere within this document.

Figure 9:
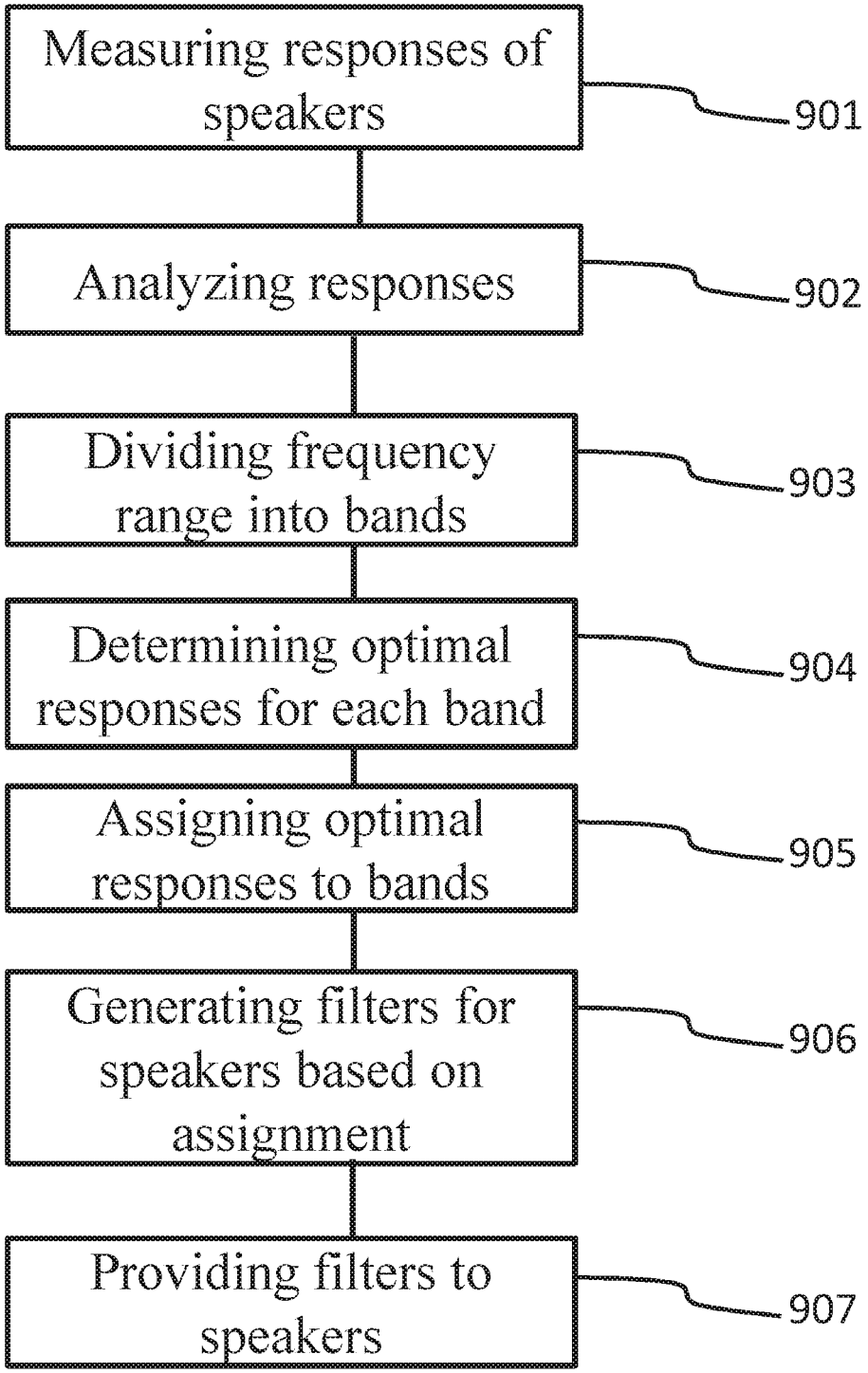
FIG. 9 is a flow graph illustrating an exemplary method in accordance with at least some of the embodiments of the present invention.

FIG. 9 illustrates a second exemplary method in accordance with the present disclosure. The method is comprised of steps 901, 902, 903, 904, 905, 906 and 907.

In step 901, the responses of the speakers within a sound system are measured in accordance with any suitable measuring techniques, including those disclosed within this document. The responses are stored for analysis. In step 902, the responses are analysed in accordance with the techniques disclosed within this document. In step 903, the frequency range of the sound system, which is determined either by preset or by the minimal and maximal frequency of the measured responses, is divided into operating bands in accordance with the division methods disclosed within this document. In step 904, optimal responses are determined for each band in accordance with the methods for determination as disclosed within this document. In step 905, each operating band is assigned its optimal response, i.e. the response of the one or more speakers are selected which provide the flattest response within the operating band. In step 906, the filters corresponding with the assignments are generated for each speaker individually, in accordance with the generation procedures disclosed within this document. Equalization may be done as part of the filter generation process as disclosed within this document. In step 907, the filters are provided to each speaker in accordance with the provision procedures disclosed within this document.

In accordance with the embodiments presented herein, the overall response of the sound system at a first location is comprised of the responses within the operating bands, wherein one or more responses may be selected for use within the operating band and wherein the operating bands may partially overlap. In a further exemplary embodiment, some of the loudspeakers within the sound system are used with bands and at least one speaker is used as is, i.e. the natural response of the speaker is used. This has the beneficial effect of minimizing the amount of processing required in the system.

In an exemplary embodiment, the overall response may consist of the responses within the operating bands, wherein one or more responses may be selected for use within the operating band. This has the beneficial effect of further improvement to the response flatness.

Advantages of the present disclosure include that a flatter overall response is produced at one or more listener positions. In addition, the effect of different rooms on the output of the sound system is minimised, as the conditions can be accounted for. Speakers can also be placed more flexibly within the rooms as any adverse effects on the total response can be minimised.

With respect to digital sound processing done locally or remotely, sound processing may be done using for example, at least one computing device such as at least one of the following: computing device, mobile device, server, node, cloud computing device. A computing device may be located within the speaker and comprise the DSP, or alternatively or additionally the computing device may be located within the network interface. The computing device comprises at least one processor, which may comprise, for example, a single- or multi-core processor wherein a single-core processor comprises one processing core and a multi-core processor comprises more than one processing core. The processor may comprise more than one processor. A processing core may comprise, for example, a Cortex-A8 processing core by ARM Holdings or a Steamroller processing core produced by Advanced Micro Devices Corporation. The processor may comprise at least one Qualcomm Snapdragon and/or Intel Core processor, for example. The processor may comprise at least one application-specific integrated circuit, ASIC. The processor may comprise at least one field-programmable gate array, FPGA. The processor may be a means for performing method steps in the computing device. The processor may be configured, at least in part by computer instructions, to perform actions. In the context of the present disclosure, it is understood that the sound processing may be completed by several devices in cooperation.

Devices such as loudspeakers, microphones and network interfaces may interface with each other and external computing devices using at least one of the following technologies: direct wiring such as electrical wires, coaxial cable, fiber optic cable, infrared transmission, Bluetooth, wireless local area network, WLAN, Ethernet, universal serial bus, USB, and/or worldwide interoperability for microwave access, WiMAX, and satellite communication methods, for example. Alternatively or additionally, a proprietary communication framework may be utilized. In some embodiments, separate networks may be used for one or more of the following purposes: communication between loudspeakers, communication between loudspeakers and network interfaces, communication between network interfaces and servers, et cetera.

It is to be understood that the embodiments of the invention disclosed are not limited to the particular structures, process steps, or materials disclosed herein, but are extended to equivalents thereof as would be recognized by those ordinarily skilled in the relevant arts. It should also be understood that terminology employed herein is used for the purpose of describing particular embodiments only and is not intended to be limiting.

Reference throughout this specification to one embodiment or an embodiment means that a particular feature, structure, or characteristic described in connection with the embodiment is included in at least one embodiment of the present invention. Thus, appearances of the phrases "in one embodiment" or "in an embodiment" in various places throughout this specification are not necessarily all referring to the same embodiment. Where reference is made to a numerical value using a term such as, for example, about or substantially, the exact numerical value is also disclosed.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various embodiments and example of the present invention may be referred to herein along with alternatives for the various components thereof. It is understood that such embodiments, examples, and alternatives are not to be construed as de facto equivalents of one another, but are to be considered as separate and autonomous representations of the present invention.

Furthermore, the described features, structures, or characteristics may be combined in any suitable manner in one or more embodiments. In this description, numerous specific details are provided, such as examples of lengths, widths, shapes, etc., to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The verbs "to comprise" and "to include" are used in this document as open limitations that neither exclude nor require the existence of also un-recited features. The features recited in depending claims are mutually freely combinable unless otherwise explicitly stated. Furthermore, it is to be understood that the use of "a" or "an", that is, a singular form, throughout this document does not exclude a plurality.

INDUSTRIAL APPLICABILITY

At least some embodiments of the present invention find industrial application in audio engineering, more specifically in providing optimized or improved responses for sound systems.

REFERENCE SIGNS LIST

| | |
|---|---|
| 10 | input audio signal, x |
| 11 | speaker anechoic characteristics |
| 12 | room acoustic characteristics |
| 110 | speaker anechoic response |
| 150 | room response of speaker, y |
| 21, 22 | notch in response |
| 160 | room response of speaker at second listening position |
| 13 | room acoustic characteristics at second listening position |
| 31, 32 | notch in response |
| 170 | response of first speaker |
| 175 | response of second speaker |
| 176 | response of third speaker |
| 179 | overall system response |
| 181, 182, 183, 184 | operating bands |
| 500 | sound system |
| 501 | sound source |
| 502 | network interface and microphone preamplifier |
| 503 | microphone |
| 510, 520, 530 | speaker enclosure |
| 511, 521, 531 | digital signal processor |
| 512, 522, 532 | amplifier |
| 513, 523, 533 | speaker element |
| 600 | sound system |
| 601 | sound source |
| 602 | network interface |
| 603 | microphone |
| 610, 620 | speaker enclosure |
| 611, 621 | digital signal processor |
| 612, 614, 622 | amplifier |
| 613, 615, 623 | speaker element |
| 700 | sound system |
| 703 | microphone |
| 708 | sound source, network interface and microphone preamplifier |
| 710 | speaker enclosure |
| 711 | digital signal processor |
| 712, 714, 716 | amplifier |
| 713, 715, 717 | speaker element |
| 801, 802, 803, 804, 805, 806 | steps of method |
| 901, 902, 903, 904, 905, 906, 907 | steps of method |

The invention claimed is:

1. A sound system, the sound system comprising:

a first speaker element, a second speaker element, at least one digital signal processor, and at least one processing unit, wherein the first and second speaker elements have at least partially overlapping frequency ranges, and the first speaker element is configured to produce a response within at least one first operating band defined within the frequency range of the first speaker element, and the second speaker element is configured to produce a response within at least one second operating band defined within the frequency range of the second speaker element, and wherein the overall response of the sound system at a first location is comprised of the response of the first speaker element within the first operating band and the response of the second speaker element within the second operating band, wherein the at least one processing unit is configured to:

cause the response of the first speaker element to be measured in a first measurement, cause the response of the second speaker element to be measured in a second measurement, to analyze said measured first and second responses, and to define the first operating band and the second operating band responsive to a determination based on the analysis, wherein the analysis comprises locating notches in said responses, and wherein the determination comprises calculating a solution to minimize the located notches within the overall system response.

2. The sound system in accordance with claim 1, wherein the first operating band and the second operating band have an overlap of 1 to 30 percent.

3. The sound system in accordance with claim 1, wherein the overall system response is comprised of the first operating band, the second operating band, a third operating band and a fourth operating band.

4. The sound system in accordance with claim 1, further comprising a third speaker element having a third response at the first location and wherein the third speaker element is configured to produce said third response within at least one operating band, said at least one operating band being located within a frequency range of the third speaker element.

5. The sound system in accordance with claim 1, wherein the speaker elements are comprised in active loudspeakers.

6. The sound system in accordance with claim 4, wherein the first, second and third speaker elements are located within a single enclosure.

7. The sound system in accordance with claim 4, wherein the first, second and third speaker element are located within separate enclosures and wherein at least some of the separate enclosures are comprised of multiple speaker elements.

8. The sound system in accordance with claim 1, wherein at least some of the speaker elements are at least one of: woofer, tweeter.

9. The sound system in accordance with claim 1, wherein at least one speaker element is configured to operate in at least two operating bands to form the overall response of the system.

10. The sound system in accordance with claim 1, wherein equalization is used to fit responses of individual speaker elements to a magnitude target of the overall system response.

11. The sound system in accordance with claim 1, wherein all-pass equalizer parameters and group delay are optimized between the individual speakers.

12. A method of improving a quality of a response of a sound system, the method comprising:

measuring at a first location a response of a first speaker to obtain a first response, measuring at the first location a response of a second speaker to obtain a second response, analyzing the first and second responses, based at least partly on the analysis, dividing the frequency range of the first and second response into operating bands, based at least partly on the analysis, assigning the first speaker or the second speaker to each operating band, based at least partly on the assigning, generating a first set of filters for the first speaker and a second set of filters for the second speaker, and providing the first set of filters to the first speaker and the second set of filters to the second speaker in order to implement an overall sound system response, wherein the analysis comprises locating notches in said responses, and wherein the determination comprises calculating a solution to minimize the located notches within the overall system response.

13. The method in accordance with claim 12, the first operating band and the second operating band have an overlap of 1 to 30 percent.

14. The method in accordance with claim 12, wherein the response at least one speaker is used in at least two operating bands to form the overall response of the system.

15. The method in accordance with claim 12, wherein at least one of the set of filters comprises a parametric shelving filter.

16. The method in accordance with claim 12, wherein the frequency range is divided into between 2 and 20 operating bands.

17. The method in accordance with claim 12, wherein the at least one of the set of filters is stored within an enclosure of a speaker element and on a remote server.

18. A non-transitory computer readable medium configured to cause a method of improving a quality of a response of a sound system to be performed, the method comprising:

measuring at a first location a response of a first speaker to obtain a first response, measuring at the first location a response of a second speaker to obtain a second response, analyzing the first and second responses, based at least partly on the analysis, dividing the frequency range of the first and second response into operating bands, based at least partly on the analysis, assigning the first speaker or the second speaker to each operating band, based at least partly on the assigning, generating a first set of filters for the first speaker and a second set of filters for the second speaker, and providing the first set of filters to the first speaker and the second set of filters to the second speaker in order to implement an overall sound system response wherein the analysis comprises locating notches in said responses, and wherein the determination comprises calculating a solution to minimize the located notches within the overall system response.

19. The method in accordance with claim 12, wherein phase optimization is conducted for the final system response.

* * * * *